US009444229B2

(12) United States Patent
Kinoshita et al.

(10) Patent No.: US 9,444,229 B2
(45) Date of Patent: Sep. 13, 2016

(54) SPARK PLUG FOR INTERNAL COMBUSTION ENGINE THAT ENSURES STABLE AND HIGH IGNITABILITY WHEN HIGH FREQUENCY VOLTAGE IS APPLIED

(71) Applicants: NIPPON SOKEN, INC., Nishio, Aichi-pref. (JP); DENSO CORPORATION, Kariya, Aichi-pref. (JP)

(72) Inventors: Shota Kinoshita, Nishio (JP); Shinichi Okabe, Aichi-ken (JP); Akitmitsu Sugiura, Nagoya (JP)

(73) Assignees: DENSO CORPORATION, Kariya (JP); NIPPON SOKEN, INC., Nishio (JP)

( * ) Notice: Subject to any disclaimer, the term of this patent is extended or adjusted under 35 U.S.C. 154(b) by 0 days.

(21) Appl. No.: 14/847,314

(22) Filed: Sep. 8, 2015

(65) Prior Publication Data

US 2016/0072259 A1 Mar. 10, 2016

(30) Foreign Application Priority Data

Sep. 8, 2014 (JP) ..... 2014-182557

(51) Int. Cl.
*H01T 13/32* (2006.01)
*H01T 13/52* (2006.01)

(52) U.S. Cl.
CPC ..... *H01T 13/32* (2013.01); *H01T 13/52* (2013.01)

(58) Field of Classification Search
CPC ..... H01T 13/32; H01T 13/52; H01T 21/02; H01T 13/39; H01T 13/38; H01T 13/20; H01T 13/34; H01T 13/36; H01T 13/467
USPC ..... 313/118–145; 123/169 R, 169 EL, 32, 123/41, 310
See application file for complete search history.

(56) References Cited

U.S. PATENT DOCUMENTS 7,816,846 B2 * 10/2010 Takada ..... H01T 13/18 313/141
2010/0072874 A1 * 3/2010 Liao ..... H01T 13/32 313/139
2012/0048250 A1 3/2012 Shimoda et al.

FOREIGN PATENT DOCUMENTS

JP 2012-048889 3/2012
JP 2013-186998 9/2013

* cited by examiner

*Primary Examiner* — Tracie Y Green
(74) *Attorney, Agent, or Firm* — Nixon & Vanderhye P.C.

(57) ABSTRACT

A spark plug for an internal combustion engine includes a ground electrode, an insulator held inside the ground electrode, and a center electrode held inside the insulator. When a segment of a line extending in a plug radial direction to connect an arbitrary start point on a surface of the ground electrode and an outer peripheral surface of the insulator is a line segment H, a point of intersection between the line segment H and the outer peripheral surface of the insulator is an intersection point K, a length of the line segment H is L1, and an axial distance between the intersection point K and the distal end of the insulator is L2, the ground electrode is provided on the surface thereof with a shortest discharge forming portion as the start point along a plug circumferential direction at which a value of (L1+L2) becomes minimum.

6 Claims, 12 Drawing Sheets

SPARK PLUG FOR INTERNAL COMBUSTION ENGINE THAT ENSURES STABLE AND HIGH IGNITABILITY WHEN HIGH FREQUENCY VOLTAGE IS APPLIED

This application claims priority to Japanese Patent Application No. 2014-182557 filed on Sep. 8, 2014, the entire contents of which are hereby incorporated by reference.

BACKGROUND OF THE INVENTION

1. Field of the Invention

The present invention relates to a spark plug for an internal combustion engine.

2. Description of Related Art

Japanese Patent Application Laid-open No. 2013-186998 describes a spark plug for an internal combustion engine, which is configured to generate a spark discharge between its cylindrical ground electrode and center electrode when a high-frequency voltage is applied to the center electrode. This spark plug has the structure in which a cylindrical insulator is disposed such that the distal end thereof projects into the inside of the cylindrical ground electrode, and the distal end of the center electrode projects into the inside of the cylindrical insulator.

In this spark plug, when a high-frequency voltage or a pulse voltage is applied to the center electrode, a streamer discharge is generated in the beginning so as to cover the surface of the insulator mainly from the ground electrode. Thereafter, the streamer discharge spreads toward the center electrode, as a result of which a discharge path is formed between the center electrode and the ground electrode, and a glow discharge or an arc discharge is generated. An air-fuel mixture is ignited by this discharge. In the following, the word "discharge" means not a streamer discharge but a glow discharge or an arc discharge unless otherwise noted.

If the generated discharge keeps covering the surface of the insulator, since the cooling loss is large and accordingly a flame does not spread sufficiently, the ignitibility is low. Accordingly, it is required that the generated discharge is caused to detach from the surface of the insulator and to spread into the air by an airflow within a combustion chamber. To spread the discharge by an airflow sufficiently, it is necessary to mount the spark plug on an internal combustion engine such that the position of the discharge relative to the insulator and the direction of the airflow are in an appropriate relationship.

However, each of the ground electrode, the insulator, and the center electrode of the spark plug described in this patent document has a shape uniform in the plug circumferential direction. Accordingly, the position at which a discharge starts to occur is not determined to any specific circumferential position of the spark plug. That is, since the discharge start position is random, it is not possible to cause a generated discharge to spread stably in whichever direction the spark plug is oriented relative to the direction of the airflow within the combustion chamber.

SUMMARY

An exemplary embodiment provides a spark plug for an internal combustion engine, including:

a cylindrical ground electrode;

a cylindrical insulator held inside the ground electrode and projecting toward a distal end side of the spark plug beyond a distal end of the ground electrode; and a center electrode held inside the insulator and projecting toward the distal end side beyond a distal end of the insulator, the spark plug being configured to generate a discharge between the ground electrode and the center electrode when applied with a high-frequency voltage at the center electrode, wherein, when a segment of a line extending in a plug radial direction to connect an arbitrary start point on a surface of the ground electrode and an outer peripheral surface of the insulator is a line segment H, a point of intersection between the line segment H and the outer peripheral surface of the insulator is an intersection point K, a length of the line segment H is L1, and an axial distance between the intersection point K and the distal end of the insulator is L2, the ground electrode is provided on the surface thereof with a shortest discharge forming portion as the start point locally along a plug circumferential direction at which a value of (L1+L2) becomes minimum.

According to the exemplary embodiment, there is provided a spark plug which ensures an internal combustion engine to have a stably high ignitability.

Other advantages and features of the invention will become apparent from the following description including the drawings and claims.

PREFERRED EMBODIMENTS OF THE INVENTION

Figure 1:
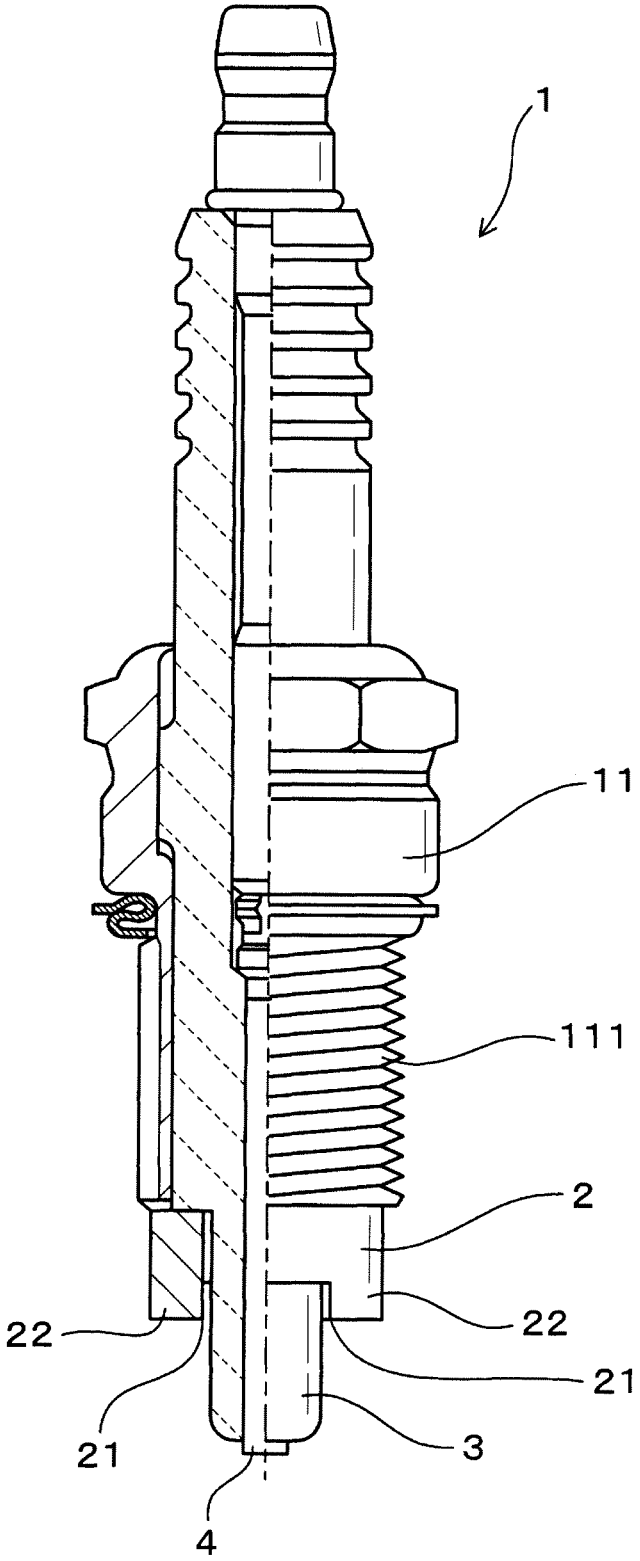
FIG. 1 is a front view, partly in cross section, of a spark plug according to a first embodiment of the invention.

Spark plugs according to the below described embodiments can be used for an internal combustion engine of a vehicle. In the following, the distal end side means one end side of the spark plug, from which it is inserted into a combustion chamber of an engine, and the proximal end side means the other end side opposite to the distal end side. Further, the plug axial direction means the longitudinal direction of the spark plug, the plug radial direction means the radial direction of the spark plug, and the plug circumferential direction means the circumferential direction of the spark plug.

In the below described embodiments, the same or equivalent components, parts or portions are designated by the same reference numerals or characters.

First Embodiment

Figure 2:
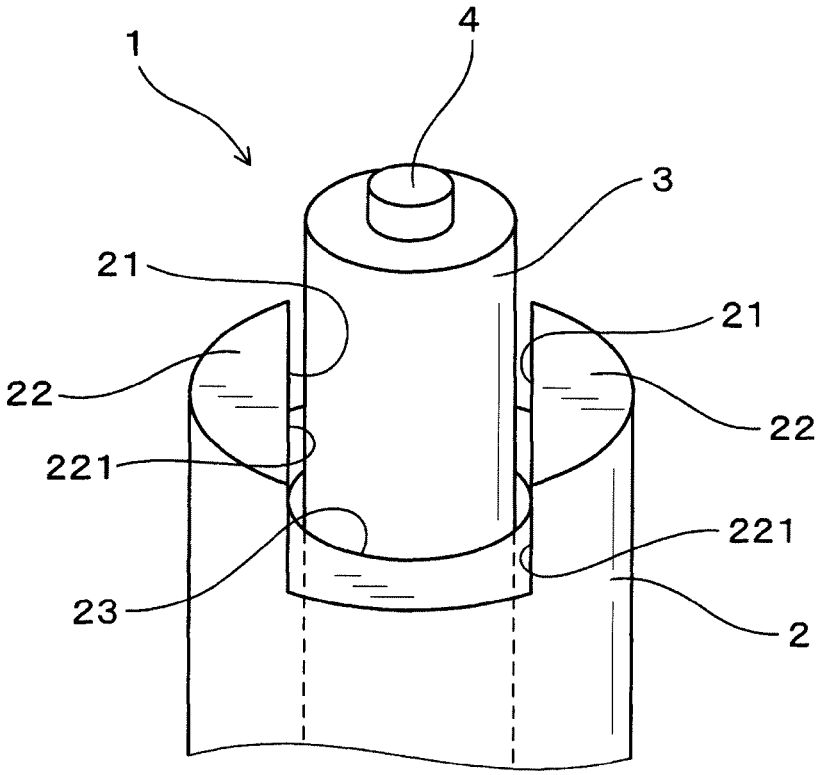
FIG. 2 is a perspective view of a distal end part of the spark plug according to the first embodiment.

A spark plug 1 according to a first embodiment of the invention is described with reference to FIGS. 1 to 6. As shown in FIGS. 1 and 2, the spark plug 1 includes a cylindrical ground electrode 2, a cylindrical insulator 3 held inside the ground electrode 2 so as to project toward the distal end side beyond the distal end of the ground electrode 2, and a center electrode 4 held inside the insulator 3 so as to project toward the distal end side beyond the distal end of the insulator 3. The spark plug 1 is configured to generate a discharge between the ground electrode 2 and the center electrode 4 when a high-frequency voltage is applied to the center electrode 4.

The structure of the spark plug 1 is described in detail below with reference to FIGS. 3 to 5. Let a line extending in the plug radial direction to connect an arbitrary start point on the surface of the ground electrode 2 and the outer peripheral surface of the insulator 3 be a line segment H (see FIG. 5). Let the point of intersection between the line segment H and the outer peripheral surface of the insulator 3 be an intersection point K. Here, it is assumed that the length of the line segment H is L1, and the axial length between the intersection point K and the distal end of the insulator 3 is L2. The ground electrode 2 is formed with a shortest discharge forming portion 21 on its surface. The sum of L1 and L2, that is, the value of (L1+L2) becomes minimum when the start point is located at the shortest discharge forming portion 21.

The definition of the shortest discharge forming portion 21 is as follows. The segment of a line extending in the plug radial direction so as to connect an arbitrary start point on the surface of the ground electrode 2 and the outer peripheral surface of the insulator 3 is defined as the line segment H. If the start point is set to the point A shown in FIGS. 4 and 5, the line segment H connects the point A and the point B shown in FIGS. 4 and 5, the point B being a point opposite to the point A in the plug radial direction. The point B becomes the intersection point K. The distance La between the points A and B is the length L1 of the line segment H. The axial length Lb between the point B and the distal end of the insulator 3 is the axial length L2 between the intersection point K and the distal end of the insulator 3.

Figure 3:
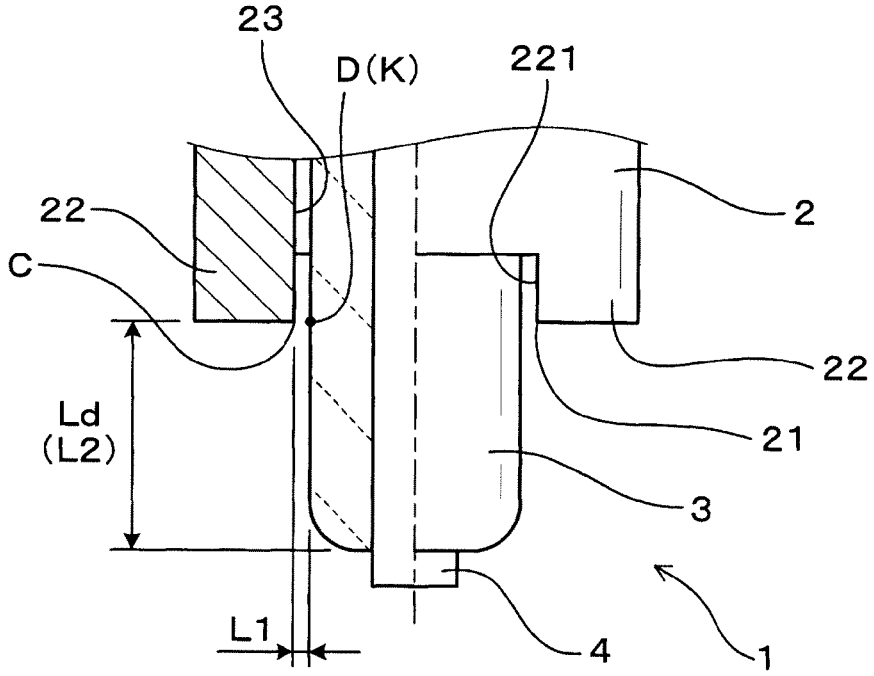
FIG. 3 is a front view, partly in cross section, of the distal end part of the spark plug according to the first embodiment.
Figure 4:
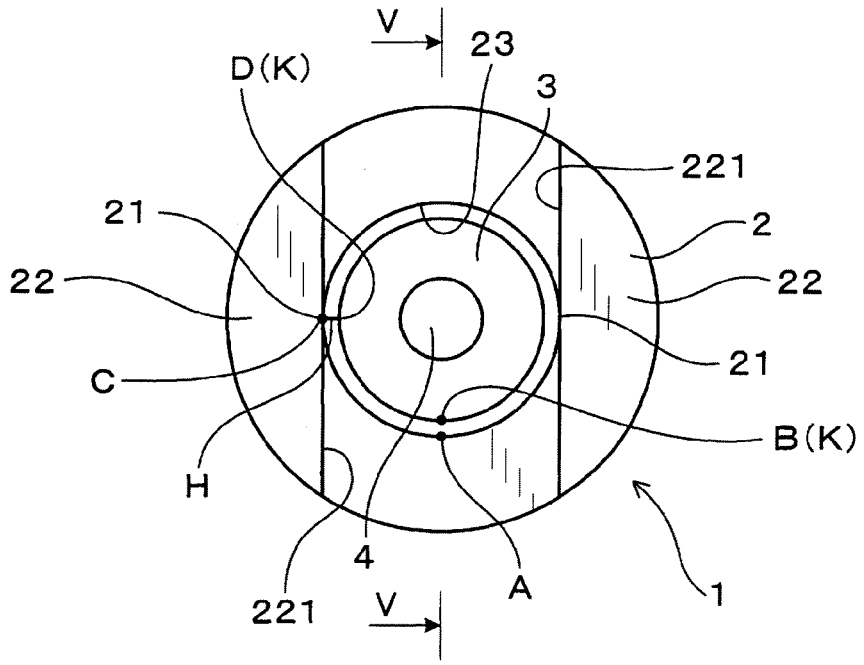
FIG. 4 is a plan view of the spark plug according to the first embodiment as viewed from the distal end side.
Figure 5:
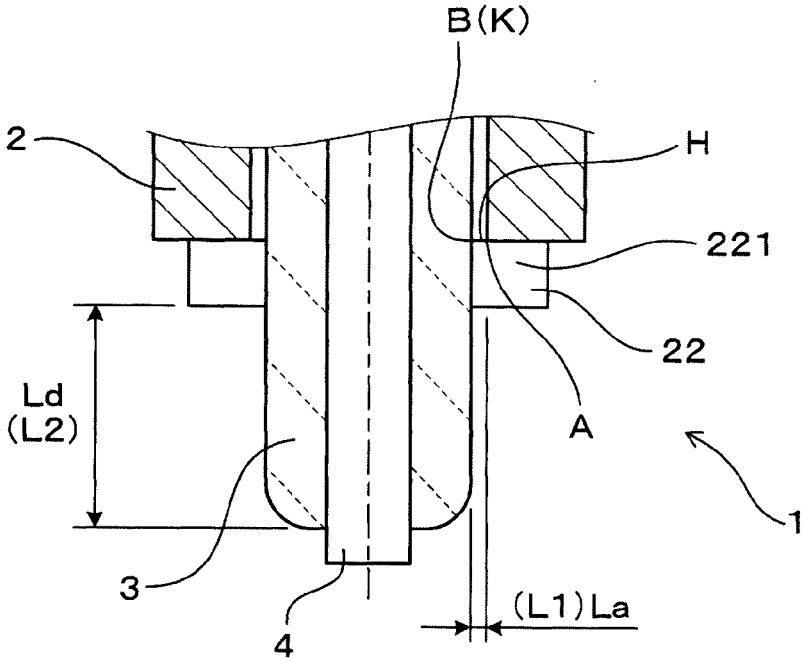
FIG. 5 is a cross-sectional view of FIG. 4 taken along line V-V.

If the start point is set to the point C shown in FIGS. 3 and 4, the line segment H connects the point C and the point D shown in FIGS. 3 and 4, the point D being opposite to the point C in the plug radial direction. The point D becomes the intersection point K. The distance Lc between the points C and D is the length L1 of the line segment H. The axial length Ld between the point D and the distal end of the insulator 3 is the axial length L2 between the intersection point K and the distal end of the insulator 3.

Accordingly, when the start point is set to the point A, L1+L2=La+Lb, and when the start point is set to the point C, L1+L2=Lc+Ld. Since La=Lc and Lb<Ld, La+Lb>Lc+Ld. The value of (L1+L2) depends on the position of the start point on the surface of the ground electrode 2.

In this embodiment, the value of (L1+L2) becomes maximum when the start point on the surface of the ground electrode 2 is set to the point C. Accordingly, the point C is present at the shortest discharge forming portion 21 on the surface of the ground electrode 2. Hence, the shortest discharge forming portion 21 is present locally along the plug circumferential direction. The shortest discharge forming portion 21 is present also at a point opposite the point C across the center electrode 4.

The ground electrode 2 also serves as the housing 11, and is formed with a mounting thread part 11 at its outer peripheral surface to be screwed to an internal combustion engine as shown in FIG. 1. The shortest discharge forming portion 21 is provided at two different positions along the plug circumferential direction. The distance along the plug circumferential direction between the two shortest discharge forming portions 21 is larger than or equal to $\pi/2$ [rad]. In this embodiment, the two shortest discharge forming portions 21 are opposite to each other across the center electrode 4, and the distance therebetween is $\pi$ [rad]. Here, the distance along the plug circumferential direction between the two shortest discharge forming portions 21 is defined as the angle formed by two straight lines each of which connects the plug center and the corresponding shortest discharge forming portion 21 when viewed from the plug distal end side.

As shown in FIGS. 2 to 4, the ground electrode 2 includes two ground projecting parts 22 which project toward the distal end side from the distal end thereof. The two ground projecting parts 22 are provided in the two shortest discharge forming portions 21, respectively. Each of the ground projecting parts 22 is formed with a counter inner surface 221. The two counter inner surfaces 221 of the two ground projecting parts 22 are opposed to each other across the insulator 3. Each of the shortest discharge forming parts 21 is disposed at the distal end of the corresponding counter inner surface 221.

In this embodiment, the counter inner surfaces 221 are flat, and parallel to each other. Each of the counter inner surfaces 221 is opposed to the outer peripheral surface of the insulator 3. As shown in FIG. 4, the position of the foot of the perpendicular line drawn from the plug center to the counter inner surface 221 coincides with the position of the shortest discharge forming portion 21 when viewed from the plug distal end side.

In this embodiment, the center electrode 4 has a columnar shape, and the insulator 3 has a cylindrical shape coaxial with the center electrode 4. The ground electrode 2 serving also as the housing 11 has roughly a cylindrical shape coaxial with the center electrode 4 and the insulator 3 except for the parts in which the ground projecting parts 22 are formed. The counter inner surface 221 of the ground projecting part 22 forms a tangent line of the inner peripheral surface 23 of the cylindrical ground electrode 2 (housing 11) when viewed in the plug axial direction. The contact position between the inner peripheral surface 23 and the counter inner surface 221 coincides the position of the shortest discharge forming portion 21 when viewed from the plug distal end side.

Since FIG. 2 schematically shows the distal end part of the spark plug 1, the corner portion between the distal end surface and the outer peripheral surface of the insulator 3 is shown not to have a curved surface. However, actually, the corner portion between the distal end surface and the outer peripheral surface of the insulator 3 has a curved surface as shown in FIGS. 3 and 5.

The first embodiment described above provides the advantages described below. The spark plug 1 includes the shortest discharge forming portions 21 on the surface of the ground electrode 2, at each of which the value of (L1+L2) becomes minimum. A discharge easily occurs at the shortest discharge forming portions 21. That is, a discharge occurs easily at specific positions along the plug circumferential direction. Accordingly, it is possible to mount the spark plug 1 on the internal combustion engine such that a discharge occurring at the shortest discharge forming portion 21 as a start point is caused to spread efficiently by an airflow and be detached from the surface of the insulator 3 at a high probability. Therefore, the spark plug 1 ensures stable ignitability.

Figure 6:
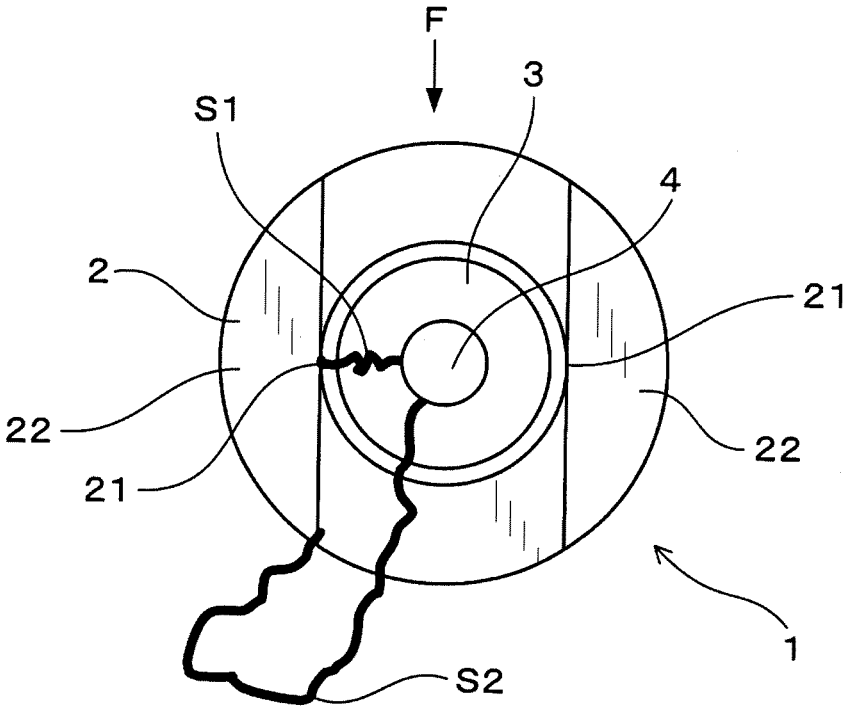
FIG. 6 is a diagram for explaining how a generated discharge is caused to spread in the spark plug according to the first embodiment.

More specifically, when the spark plug 1 is mounted on the internal combustion engine at an attitude in which the arranging direction of the center electrode 4 and the shortest discharge forming portions 21 is perpendicular to the direction of an airflow F when viewed from the plug distal end side as shown in FIG. 6, the direction of a discharge S1 occurring at the shortest discharge forming portion 21 becomes roughly perpendicular to the direction of the airflow F. In this state, the discharge S1 is caused to spread greatly by the airflow F1 to become a discharge S2.

The attitude of the spark plug 1 relative to the internal combustion engine can be adjusted by adjusting the thickness of a gasket interposed between the housing 11 and the internal combustion engine, or adjusting cutting of a mounting thread part 111 of the housing 11 and a corresponding female thread part of the internal combustion engine.

The shortest discharge forming portion 21 is provided at two different positions along the plug circumferential direction such that the two shortest discharge forming portions 21 are opposed to each other across the center electrode 4. Accordingly, when the spark plug 1 is mounted on the internal combustion engine such that the arranging direction of the center electrode 4 and the shortest discharge forming portions 21 is perpendicular to the direction of the airflow F, a discharge can be caused to spread easily. That is, in this case, when the discharge S1 starts to occur at either one of the two shortest discharge forming portions 21, the direction of arrangement of the surface of the insulator 3 and the discharge S1 is roughly perpendicular to the direction of the airflow F. As a result, the airflow F causes the discharge to spread efficiently, so that the discharge is easily detached from the insulator 3.

The ground electrode 2 includes the two ground projecting parts 22 which project to the distal end side from the distal end thereof and in which the shortest discharge forming portions 21 are provided. Accordingly, a portion at which the length L1 of the line segment H is small can be formed easily as the shortest discharge forming portion 21.

Therefore, the spark plug 1 of this embodiment ensures an internal combustion engine to have stable ignitability.

Second Embodiment

Figure 7:
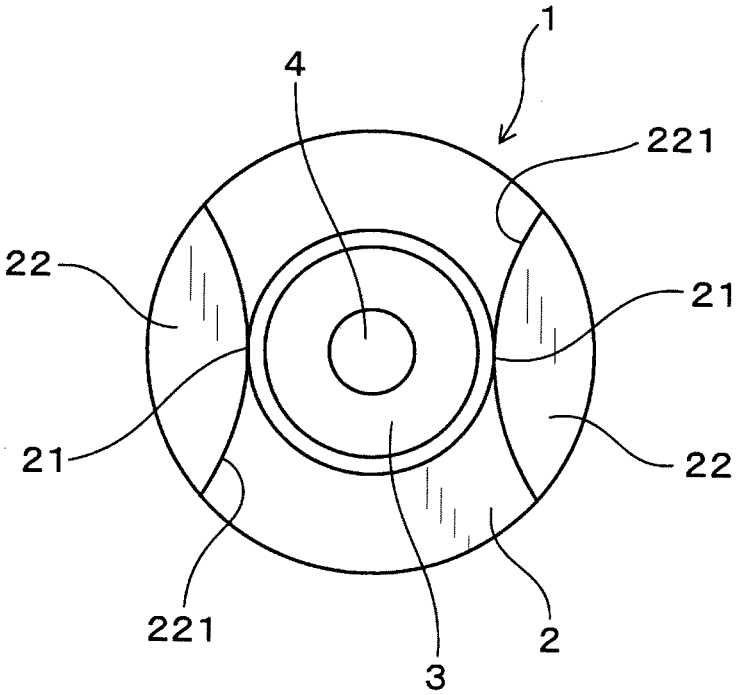
FIG. 7 is a plan view of a spark plug according to a second embodiment of the invention as viewed from the distal end side.

Next, a second embodiment of the invention is described with reference to FIG. 7. As shown in FIG. 7, in the second embodiment the counter inner surface 221 of each ground projecting part 22 is formed as curved surface. In the second embodiment, the counter inner surface 221 is curved in an arc shape so as to be convex toward the center electrode 4 when viewed from the plug distal end side. The shortest discharge forming portion 21 is located at a part of the curved counter inner surface 221, which is closest to the outer peripheral surface of the insulator 3 on the distal end side.

Except for the above, the second embodiment is the same in structure as the first embodiment.

According to the second embodiment, since the counter inner surface 221 is curved so as to be convex toward the center electrode 4 and the insulator 3, the shortest discharge forming portion 21 can be located at a specific position easily. The second embodiment provides, in addition to this advantage, the same advantages as those provided by the first embodiment.

Third Embodiment

Figure 8:
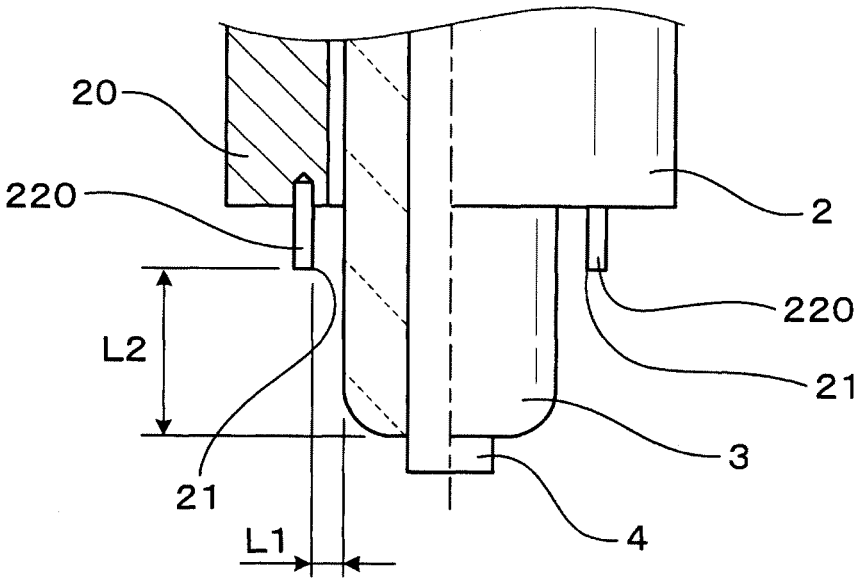
FIG. 8 is a front view, partly in cross section, of a distal end part of a spark plug according to a third embodiment of the invention.
Figure 9:
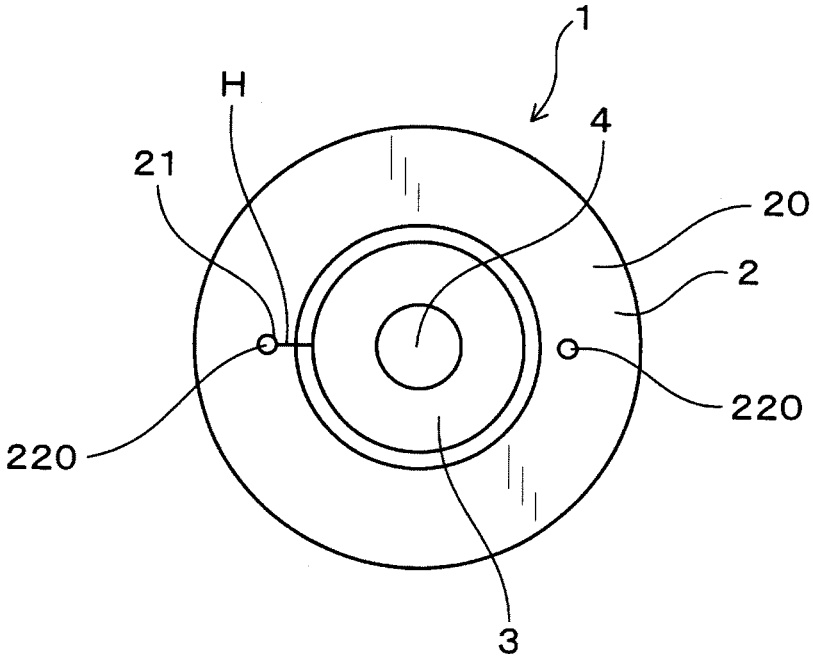
FIG. 9 is a plan view of the spark plug according to the third embodiment as viewed from the distal end side.

Next, a third embodiment of the invention is described with reference to FIGS. 8 and 9. As shown in FIGS. 8 and 9, in the third embodiment, two pin-shaped ground projecting parts 220 are fixed to the distal end of a main part 20 of the ground electrode 20 so as to project from the main part 20 to the distal end side. The distal end of each ground projecting part 220 serves as the shortest discharge forming portion 21.

The distal end part of the main part 20 of the ground electrode 2 is located such that it is level in the plug axial direction throughout its circumference except the pin-shaped ground projecting parts 220. The provision of the ground projecting parts 220 on the distal end part of the main part 20 of the ground electrode 2 makes it possible to reduce the length L2. In this embodiment, the shortest discharge forming portion 21 which serves as the start point where the value of (L1+L2) becomes minimum is formed in the distal end of each ground projecting part 220.

Except for the above, the third embodiment is the same in structure as the first embodiment.

According to the third embodiment, the ground electrode 2 can be manufactured easily, and the shortest discharge forming portions 21 can be formed easily because the main part 20 of the ground electrode 2 does not need to have a complicated shape. Further, a metal member having a pin shape fitted to distal end of the main part 20 can be used as the ground projecting part 220, and the distal end of the pin-shaped metal member can be used as the shortest discharge forming portion 21. The third embodiment provides, in addition to this advantage, the same advantages as those provided by the first embodiment.

Fourth Embodiment

Figure 10:
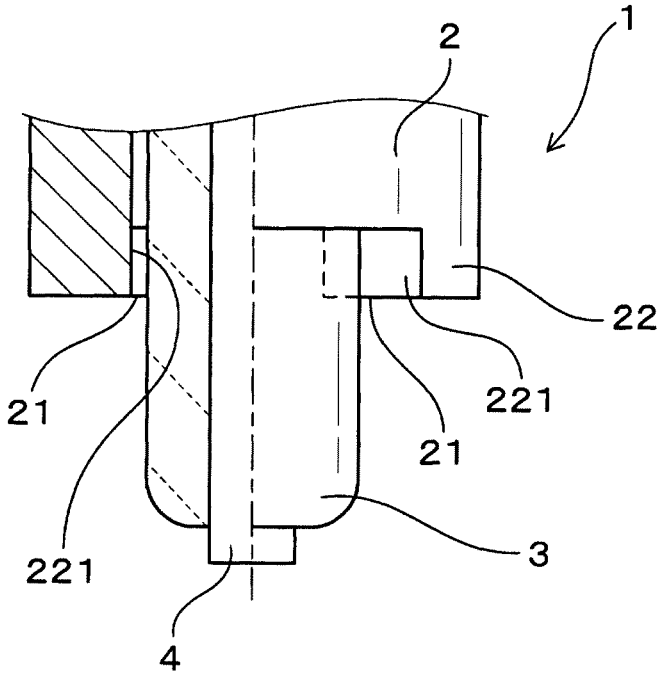
FIG. 10 is a front view, partly in cross section, of a distal end part of a spark plug according to a fourth embodiment of the invention.
Figure 11:
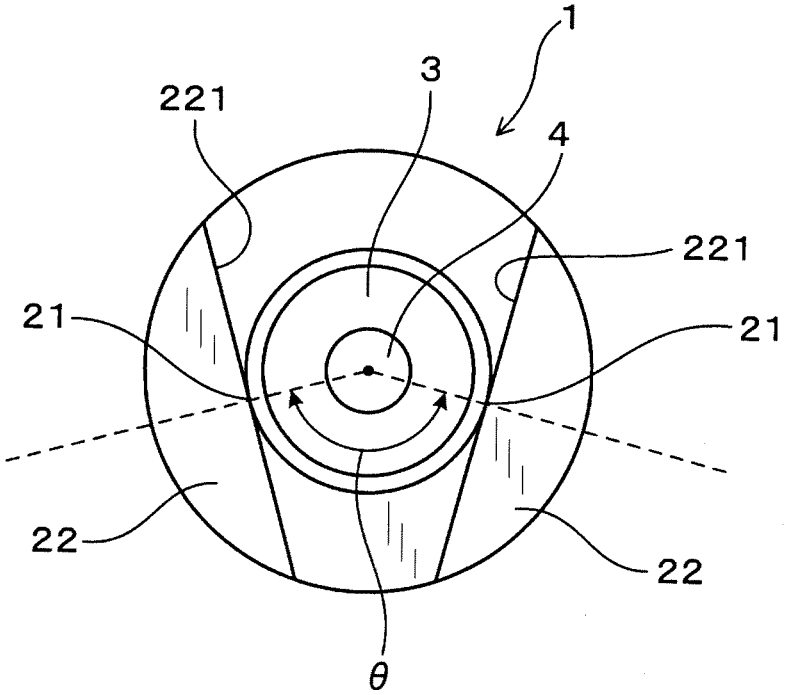
FIG. 11 is a plan view of the spark plug according to the fourth embodiment as viewed from the distal end side.

Next, a fourth embodiment of the invention is described with reference to FIGS. 10 and 11. As shown in FIGS. 10 and 11, in the fourth embodiment, the distance along the plug circumferential direction between the two shortest discharge forming portions 21 is set smaller than $\pi$ [rad]. In the first embodiment, the distance along the plug circumferential direction between the two shortest discharge forming portions 21 is $\pi$ [rad], and these two shortest discharge forming portions 21 are formed at the positions symmetrical with respect to the center electrode 4 (see FIG. 4). In this embodiment, the two shortest discharge forming portions 21 are formed at positions asymmetrical with respect to the center electrode 4. The distance (angle $\theta$) along the plug circumferential direction between the two shortest discharge forming portions 21 is smaller than $\pi$ [rad] and larger than or equal to $\pi/2$ [rad].

That is, in this embodiment, the two shortest discharge forming portions 21 are formed such that their counter inner surface 221 are opposed askew so that the relationship of $\pi/2$ [rad]$\leq\theta<\pi$ [rad] is satisfied. The angle $\theta$ is the angle formed by the normal lines to the counter inner surfaces 221.

The two counter inner surfaces 221 are formed such that the distance therebetween decreases gradually from one end to the other end when viewed from the plug distal end side. Incidentally, when the spark plug 1 is mounted on an internal combustion engine such that air flows from the direction which makes substantially an even angle with the normal lines of the two counter inner surfaces 221 when viewed from the plug distal end side, a generated discharge can be caused to spread efficiently.

Except for the above, the fourth embodiment is the same in structure as the first embodiment.

The effect of spreading a generated discharge obtained by the fourth embodiment is smaller than the first embodiment. However, as apparent from the descriptions of the below described experimental examples, since the angle $\theta$ is larger than $\pi/2$ [rad], the effect of spreading a generated discharge obtained by this embodiment is sufficient to ensure stable ignitability. The fourth embodiment provides, in addition to this advantage, the same advantages as those provided by the first embodiment.

Experimental Examples

Figure 12:
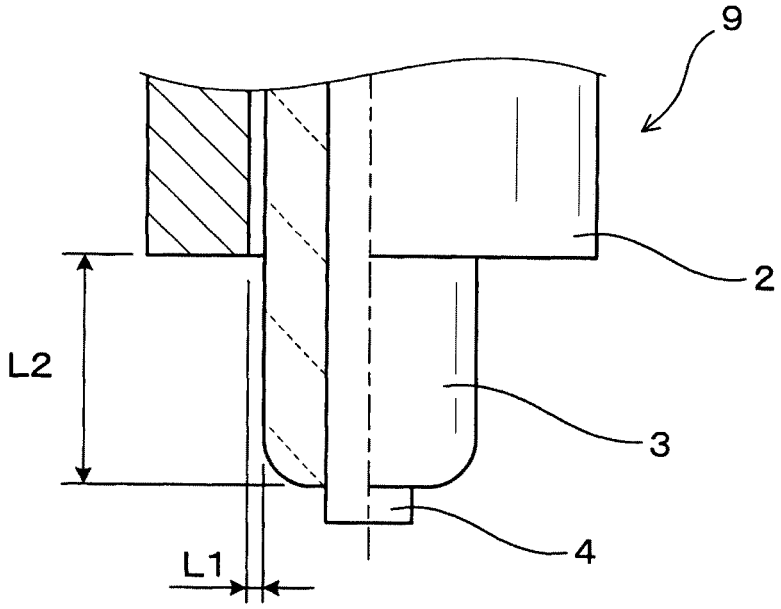
FIG. 12 is a front view, partly in cross section, of a distal end part of a spark plug of an experimental example.
Figure 13:
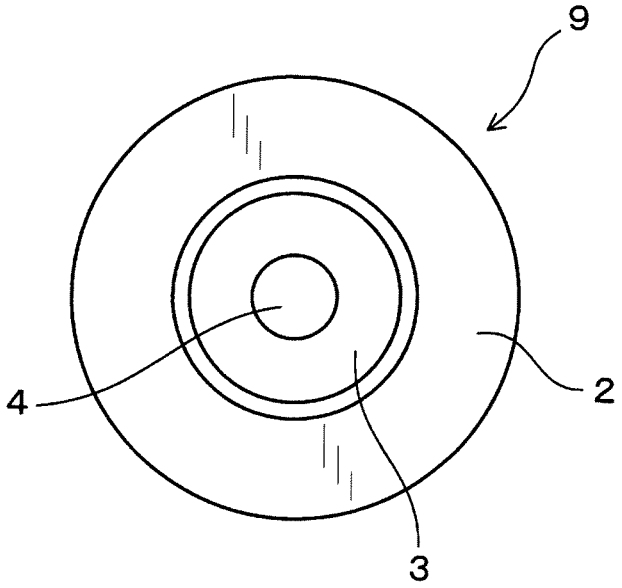
FIG. 13 is a plan view of the spark plug of the experimental example as viewed from the distal end side.

The inventors conducted an experiment to find an appropriate range of the distance between the two shortest discharge forming portions 21 along the plug circumferential direction, that is the angle $\theta$. In this experiment, a spark plug 9 not including the shortest discharge forming portions 21 was used. As shown in FIGS. 12 and 13, the spark plug 9 includes the cylindrical ground electrode 2, the cylindrical insulator 3 held inside the ground electrode 2 so as to project toward the distal end side beyond the distal end of the ground electrode 2, and the center electrode 4 held inside the insulator 3 so as to project toward the distal end side beyond the distal end of the insulator 3.

Unlike in the spark plug 1 of the first embodiment, in this spark plug 9, the distal end part of the ground electrode 2 is level throughout its circumference in the plug circumference direction. That is, the distances L1 and L2 are constant throughout the circumference in the plug circumference direction. Specifically, the diameter of the center electrode 4 is 1.6 mm, the diameter of the insulator 3 is 4.75 mm, L1=0.25 mm, and L2=3.0 mm.

The spark plug 9 was placed in a pressure vessel. High-pressure air was introduced into the pressure vessel so as to flow therein in a certain direction. The pressure of the high-pressure air was set to 0.6 MPa, and the flow velocity was set to 30 m/s. In this state, a high-frequency voltage is applied to the spark plug 9 to cause it to generate discharges. The frequency and the voltage of the high-frequency voltage was set to 820 kHz and 30 kVpp, respectively. The discharge cycle period was set to 0.8 ms.

Figure 14:
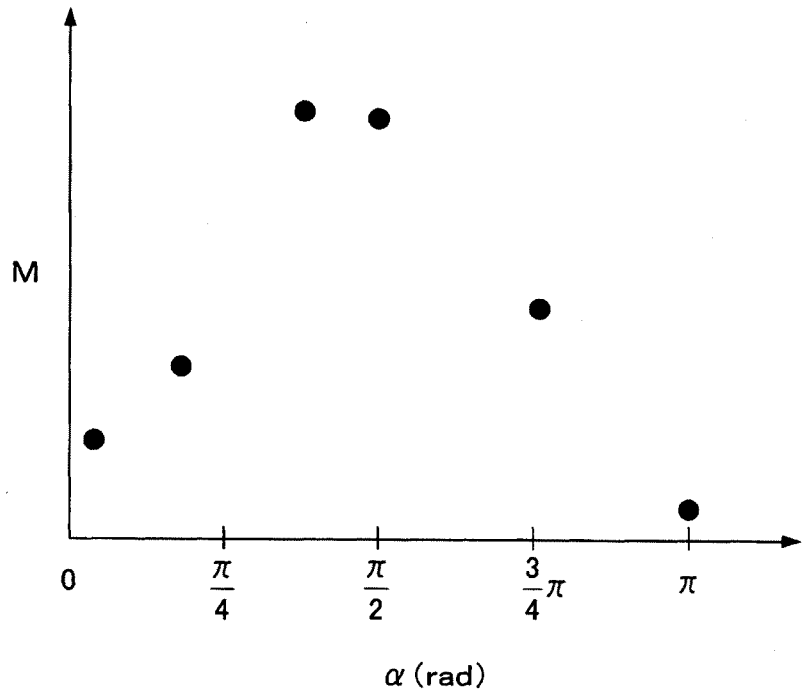
FIG. 14 is a graph showing measured results of an experiment performed on the spark plug of the experimental example.
Figure 15:
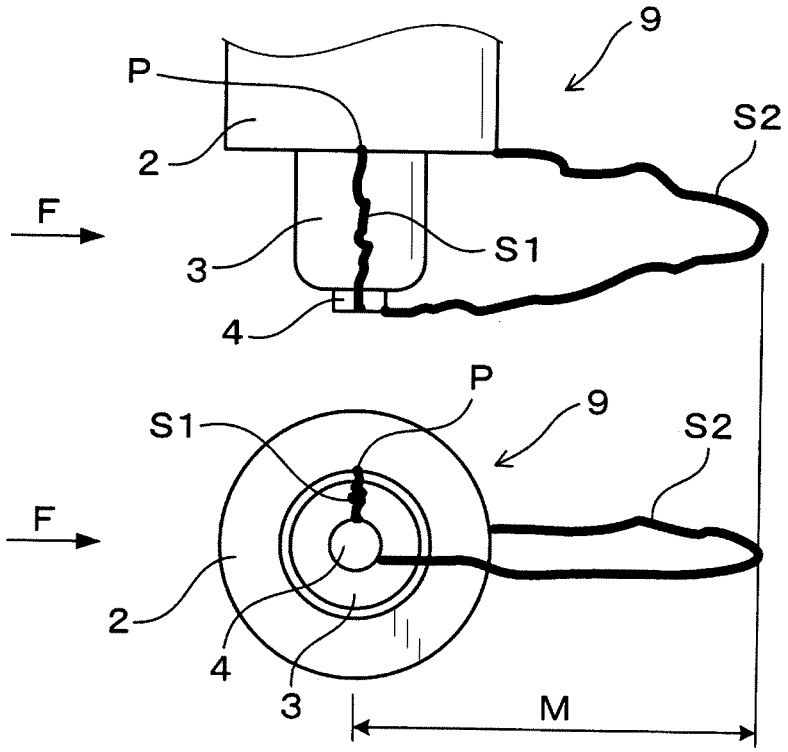
FIG. 15 is a diagram for explaining a state of a discharge when a discharge start position $\alpha=\pi/2$.
Figure 16:
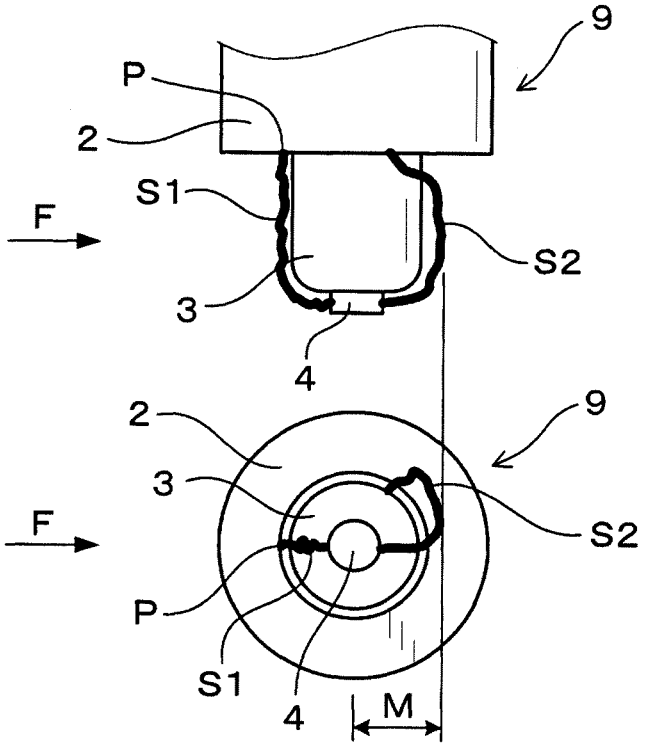
FIG. 16 is a diagram for explaining a state of a discharge when the discharge start position $\alpha=0$.

A high speed camera was used to monitor how generated discharges were caused to spread in the above set conditions. It was found that the discharge start positions are random in the plug circumferential direction. FIG. 14 shows a relationship between the discharge start positions and the magnitudes of the spreads of the generated discharges obtained by this experiment. The discharge start position is a start position P at which a discharge starts to occur in the ground electrode 2. Here, the angle formed by the vector heading from the plug center to the start position P and the vector having the direction (the leftward direction in FIGS. 15 and 16) opposite to the vector of the airflow F is defined as a discharge start position $\alpha$. That is, the discharge start position $\alpha$ shown in FIG. 15 is $\pi/2$ [rad], and the discharge start position $\alpha$ shown in FIG. 16 is 0 [rad]. Further, the distance from the plug center to the end in the plug radial direction of the discharge S2 at the moment when it has spread most distant from plug center is defined as a discharge spread M of the discharge S2. In FIGS. 15 and 16, the reference sign S1 denotes a discharge immediately after its start, and the reference sign S2 denotes the discharge having been spread by the airflow F.

As shown in FIG. 14, the discharge spread M becomes maximum when the discharge start position $\alpha$ is around $\pi/2$ [rad], and becomes minimum when the discharge start position $\alpha$ is around 0 [rad]. The discharge spread M is modestly large when the discharge start position $\alpha$ is around $3\pi/4$ [rad]. No data of the discharge spread M when the discharge start position $\alpha$ is around $\pi/4$ [rad] were obtained. However, it can be assumed that the discharge spread M when the discharge start position $\alpha$ is around $\pi/4$ [rad] is nearly the same as that when the discharge start position $\alpha$ is around $3\pi/4$ [rad] because of symmetry in the structure.

From the above results, it can be concluded that it is preferable to set the distance along the plug circumferential direction (or the angle $\theta$, see FIG. 11) between the two shortest discharge forming portions 21 equal to $\pi$ [rad], and that the discharge spread becomes sufficiently large when the angle $\theta$ is larger than or equal to $\pi/2$ [rad]. That is, by mounting the spark plug 1 on an internal combustion engine such that the arranging direction of the two shortest discharging forming portions 21 is perpendicular to the airflow direction, it is possible to sufficiently spread a generated discharge irrespective of at which shortest discharge forming portion 21 the discharge starts to occur. When the angle $\theta$ is set larger than or equal to $\pi/2$ [rad], it is possible to mount the spark plug 1 such that the discharge start position $\alpha$ satisfies the relationship of $\pi/4$ [rad]$\leq\alpha\leq3\pi/4$ [rad].

Fifth Embodiment

Figure 17:
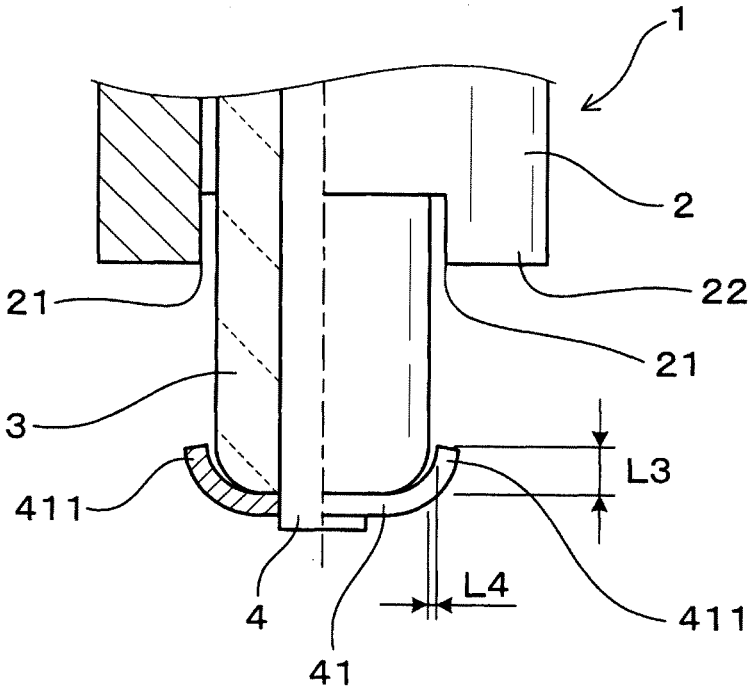
FIG. 17 is a front view, partly in cross section, of a distal end part of a spark plug according to a fifth embodiment of the invention.
Figure 18:
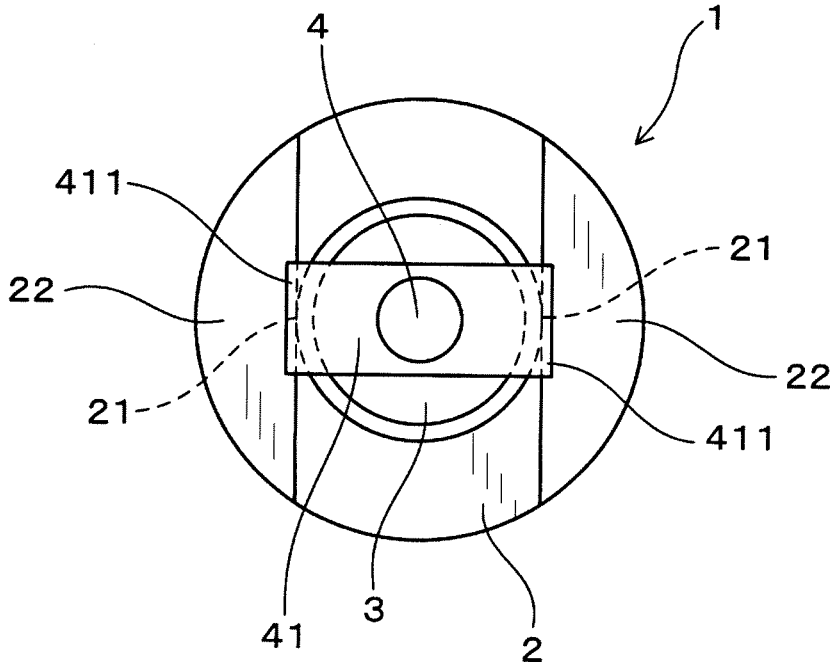
FIG. 18 is a plan view of the spark plug according to the fifth embodiment as viewed from the distal end side.

Next, a fifth embodiment of the invention is described with reference to FIGS. 17 and 18. As shown in FIGS. 17 and 18, in the fifth embodiment, an extension electrode 41 is connected to the center electrode 4, the extension electrode 41 extending radially outward from the center electrode 4 toward the shortest discharge forming portions 21.

The extension electrode 41 is formed of a plate-shaped member disposed along the distal end surface of the insulator 3 so as to contact the whole circumference of the outer peripheral surface of the center electrode 4. As shown in FIG. 18, the extension electrode 41 has a rectangular shape when viewed in the plug axial direction, the longitudinal direction of which is parallel to the arranging direction of the two shortest discharge forming portions 21.

As shown in FIG. 17, the extension electrode 41 includes proximal bent parts 411 bent from its outer end in the plug radial direction toward the proximal end side beyond the distal end of the insulator 3. The proximal bent parts 411 are bent so as to extend along the surface of the insulator 3 from the distal end surface toward the outer peripheral surface of the insulator 3. A gap is formed between each proximal bent part 411 and the outer peripheral surface of the insulator 3.

When the distance in the plug axial direction between the proximal end of the proximal bent part 411 and the distal end of the insulator 3 is L3, and the distance in the plug radial direction between the proximal end of the proximal bent part 411 and the outer peripheral surface of the insulator 3 is L4, the relationship of L4<L3 holds. Except for the above, the fifth embodiment is the same in structure as the first embodiment.

According to the fifth embodiment, the shortest discharge forming portion 21 makes the discharge start position more reliably, because the creepage distance along the surface of the insulator 3 between the shortest discharge forming portion 21 and the extension electrode 41 can be reduced.

Since the extension electrode 41 includes the proximal bent parts 411, the discharge path along the surface of the insulator 3 becomes linear when a discharge starts to occur. As a result, the discharge is caused to spread easily by an airflow. The proximal bent parts 411 are disposed more to the proximal end side than the distal end of the insulator 3 is. Accordingly, the creepage distance between the shortest discharge forming portion 21 and the extension electrode 41 can be further reduced. As a result, the shortest discharge forming portion 21 makes the discharge start position more reliable.

Since the relationship of L4<L3 is satisfied, a discharge can be guided to the discharge path between the shortest discharge forming portion 21 and the extension electrode 41 more efficiently. The fifth embodiment provides, in addition to this advantage, the same advantages as those provided by the first embodiment.

Sixth Embodiment

Figure 19:
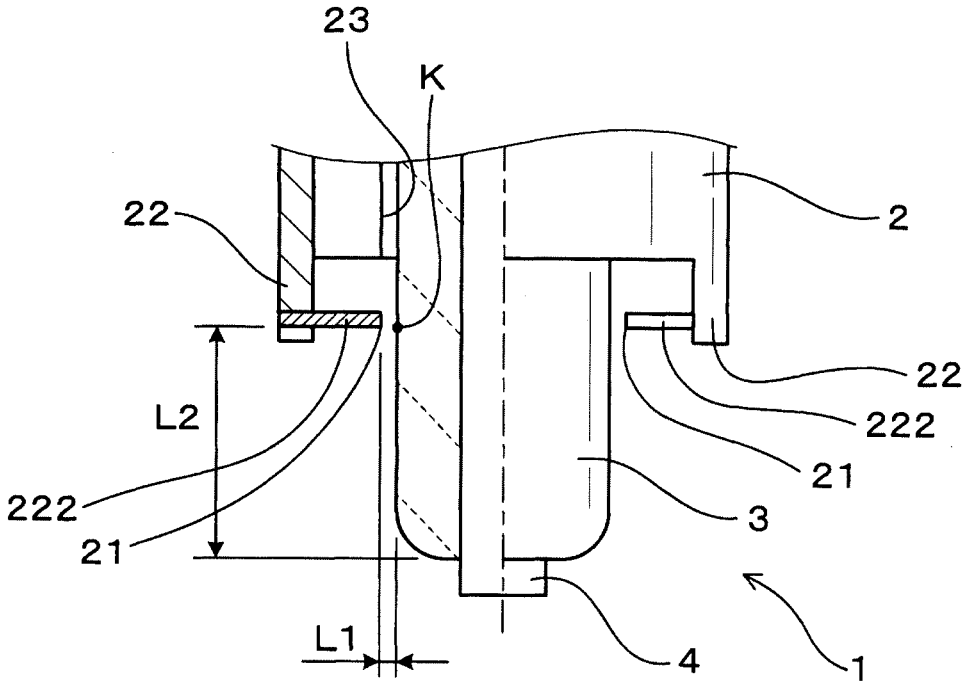
FIG. 19 is a front view, partly in cross section, of a distal end part of a spark plug according to a sixth embodiment of the invention.

Next, a sixth embodiment of the invention is described with reference to FIG. 19. As shown in FIG. 19, in the sixth embodiment, two pin-shaped inward projecting parts 222 are provided in the ground electrode 2. The main part 20 of the ground electrode 2 includes two distal projecting parts 22. The inward projecting part 222 is provided so as to extend radially inward from the counter inner surfaces 221 of the corresponding distal projecting part 22. That is, the inward projecting part 222 projects toward the outer peripheral surface of the insulator 3. The inner end edge of the inward projecting part 222 makes the shortest discharge forming portion 21 which serves as a discharge start point on the surface of the ground electrode 2 and at which the value of (L1+L2) become minimum.

The counter inner surfaces 221 of the distal projecting part 22 is located at a position which is more distant from the outer peripheral surface of the insulator 3 than the position of the counter inner surfaces 221 of the spark plug 1 of the first embodiment (see FIG. 3) is. Each distal projecting part 222 can be fixed by piling an appropriate columnar member into a hole cut in the main part 20. Except for the above, the sixth embodiment is the same in structure as the first embodiment.

According to this embodiment, since a discharge easily occurs at the shortest discharge forming portions 21, the ignitibility can be increased. The sixth embodiment provides, in addition to this advantage, the same advantages as those provided by the first embodiment.

Seventh Embodiment

Figure 20:
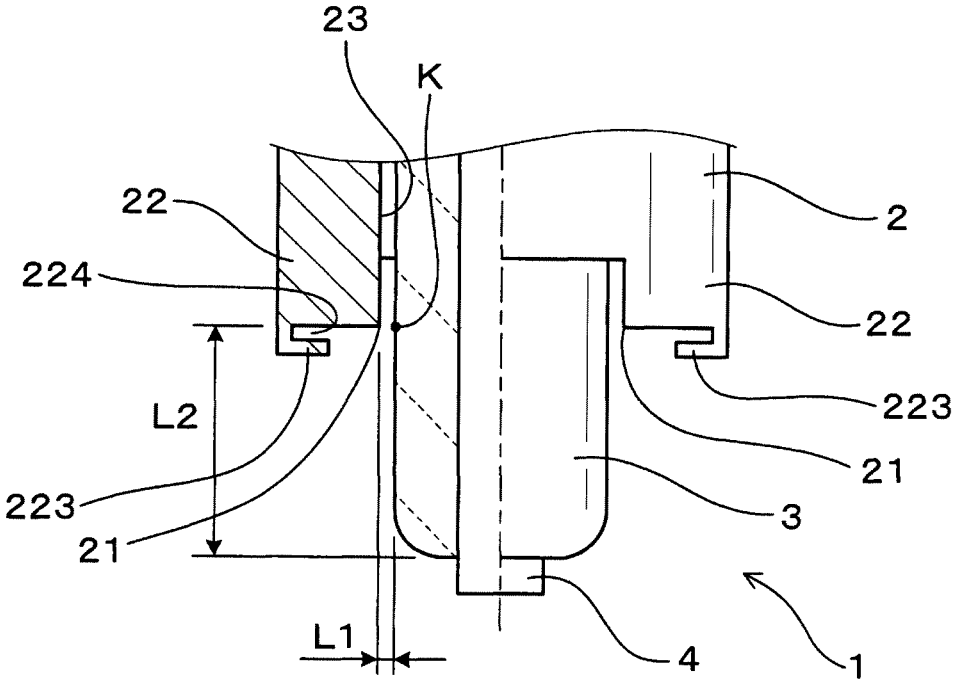
FIG. 20 is a front view, partly in cross section, of a distal end part of a spark plug according to a seventh embodiment of the invention.

Next, a seventh embodiment of the invention is described with reference to FIG. 20. As shown in FIG. 20, in the seventh embodiment, a step part 223 is provided in each distal projecting part 22 of the ground electrode 2. The step part 223 is formed by causing a part of the outer periphery of the distal projecting part 22 to project toward the distal end side beyond the inner periphery of the distal projecting part 22. The inner end edge of the step part 223 is located distant from the outer peripheral surface of the insulator 3. The step part 223 is formed with a groove part 224 cut from the inside so as to extend in the direction perpendicular to the plug axial direction.

In this embodiment, the value of (L1+L2) does not become minimum when the inner end edge of the step part 223 is set as the start point on the surface of the ground electrode 2. That is, the inner end edge of the step part 223 is not the shortest discharge forming portion 21. As in the first embodiment, in this embodiment, a part of the counter inner surface 221 of the distal projecting part 22 is the start point on the surface of the ground electrode 2 at which the value of (L1+L2) becomes minimum.

The seventh embodiment provides the same advantages as those provided by the first embodiment.

Eighth Embodiment

Figure 21:
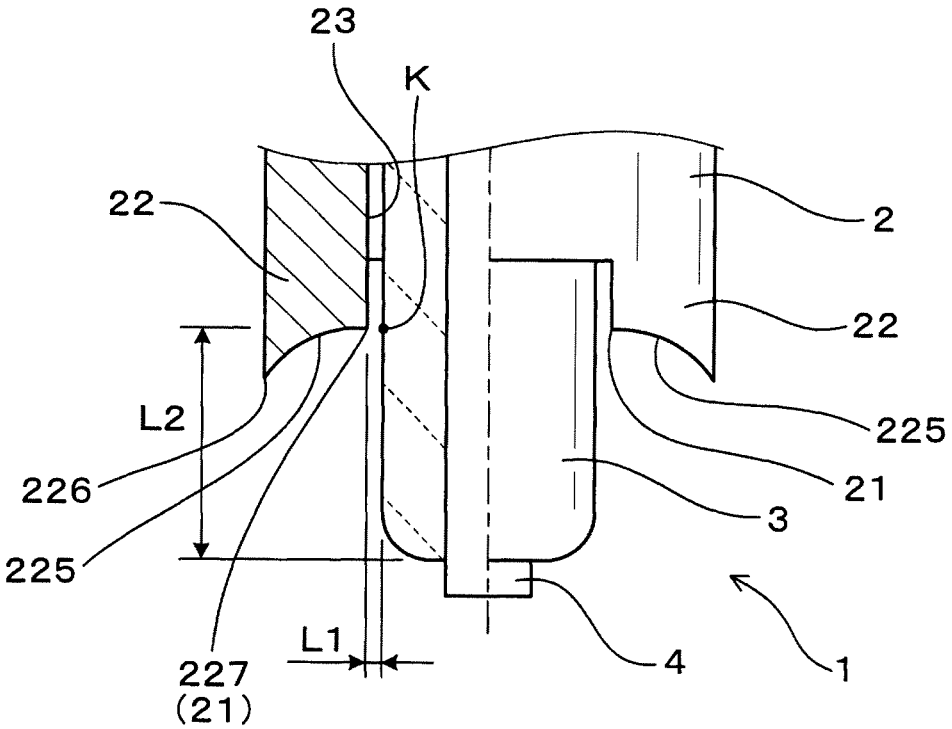
FIG. 21 is a front view, partly in cross section, of a distal end part of a spark plug according to an eighth embodiment of the invention.

Next, an eighth embodiment of the invention is described with reference to FIG. 21. As shown in FIG. 21, in this embodiment, the distal projecting part 22 has a distal end surface 225 which is a concave curved surface. The outer peripheral end edge 226 of the distal end surface 225 of the distal projecting part 22 is more to the distal end side than the inner peripheral end edge 227 of the distal projecting part 22 is. However, in this embodiment, the value of (L1+L2) does not become minimum when the outer peripheral end edge 226 is set as the start point on the surface of the ground electrode 2. That is, the outer peripheral end edge 226 is not the shortest discharge forming portion 21. A part of the inner peripheral end edge 227 is the start point on the surface of the ground electrode 2 at which the value of (L1+L2) becomes minimum.

The eighth embodiment provides the same advantages as those provided by the first embodiment.

Ninth Embodiment

Figure 22:
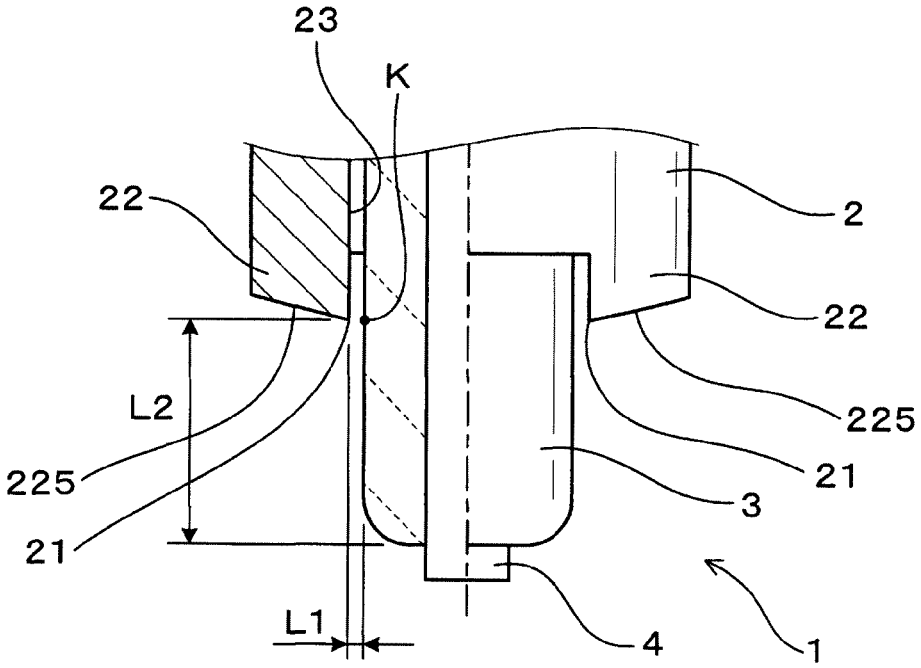
FIG. 22 is a front view, partly in cross section, of a distal end part of a spark plug according to a ninth embodiment of the invention.

Next, a ninth embodiment of the invention is described with reference to FIG. 22. As shown in FIG. 22, in this embodiment, the distal end surface 225 of the distal projecting part 22 is tapered so as to approach the distal end side toward the plug center axis. Like in the first embodiment, in this embodiment, the inner peripheral end edge of the distal projecting part 22 serves as the shortest discharge forming portion 21. Except for the above, the ninth embodiment is the same in structure as the first embodiment.

According to this embodiment, it is easy to configure that the value of (L1+L2) at the shortest discharge forming portion 21 is smaller than that at any other portion. That is, the shortest discharge forming portion 21 can be formed more easily. In addition, since the shortest discharge forming portion 21 is formed at an acute corner part, electric field concentration occurs more easily, and accordingly, a discharge occurs more easily. The ninth embodiment provides, in addition to this advantage, the same advantages as those provided by the first embodiment.

Tenth Embodiment

Figure 23:
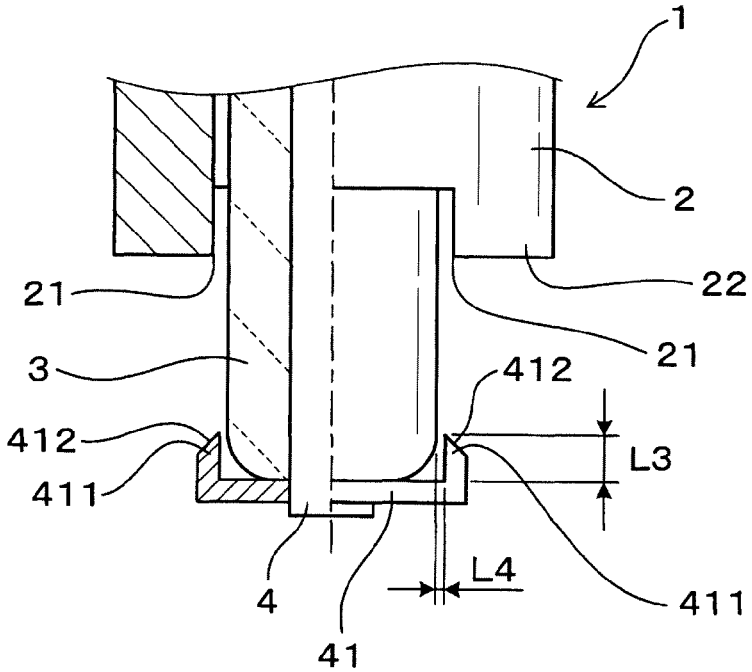
FIG. 23 is a front view, partly in cross section, of a distal end part of a spark plug according to a tenth embodiment of the invention.

Next, a tenth embodiment of the invention is described with reference to FIG. 23. This embodiment is a modification of the fifth embodiment. In the fifth embodiment, the proximal bent part 411 is curved so as to extend along the surface of the insulator 3 from the distal end surface to the outer peripheral surface of the insulator 3 as shown in FIG. 17. On the other hand, in this embodiment, the proximal bent part 411 is bent at roughly a right angle from the outer peripheral end edge of the extension electrode 41 toward the proximal end side as shown in FIG. 23.

Further, the proximal end surface 412 of the proximal bent part 411 is tapered so as to approach the proximal end side toward the plug center axis. Accordingly, the inner peripheral end edge of the proximal end surface 412 of the proximal bent part 411 makes an acute corner. Except for the above, the tenth embodiment is the same in structure as the fifth embodiment.

According to the tenth embodiment, since the inner peripheral end edge of the proximal end surface 412 of the proximal bent part 411 is formed at the acute corner, a discharge can be generated stably between the shortest discharge forming portion 21 and the inner peripheral end edge of the proximal end surface 412. The tenth embodiment provides, in addition to this advantage, the same advantages as those provided by the fifth embodiment.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine, comprising:

a cylindrical ground electrode;

a cylindrical insulator held inside the ground electrode and projecting toward a distal end side of the spark plug beyond a distal end of the ground electrode; and a center electrode held inside the insulator and projecting toward the distal end side beyond a distal end of the insulator, the spark plug being configured to generate a discharge between the ground electrode and the center electrode when applied with a high-frequency voltage at the center electrode, wherein a line segment of an imaginary line extends in a plug radial direction to connect a start point on a surface of the ground electrode and an outer peripheral surface of the insulator, the line segment and the outer peripheral surface of the insulator intersect at an intersection point, the line segment has a first length, and an axial distance between the intersection point and the distal end of the insulator is a second length, and the ground electrode is provided on the surface thereof with a shortest discharge forming portion as the start point locally along a plug circumferential direction at which a value of a sum of the first length and the second length becomes minimum.

2. The spark plug according to claim 1, wherein the shortest discharge forming portion is provided at two locations along the plug circumferential direction, a distance therebetween being larger than or equal to $\pi/2$ [rad].

3. The spark plug according to claim 1, wherein the ground electrode includes a ground projecting part which projects toward the distal end side from the distal end thereof and in which the shortest discharge forming portion is provided.

4. The spark plug according to claim 1, further comprising an extension electrode which extends from the center electrode in a plug radial direction toward the shortest discharge forming portion.

5. The spark plug according to claim 4, wherein the extension electrode includes a proximal bent part which is bent from an outer end edge thereof in the plug radial direction toward a proximal end side of the plug beyond the distal end of the insulator.

6. The spark plug according to claim 5, wherein, a distance in a plug axial direction between a proximal end of the proximal bent part and the distal end of the insulator is a third length, and a distance in the plug radial direction between the proximal end of the proximal bent part and the outer peripheral surface of the insulator is a fourth length, and the fourth length is less than the third length.

* * * * *